United States Patent [19]

Hone et al.

[11] 4,336,626

[45] Jun. 29, 1982

[54] CONTROLLED FORCE SAFETY SWITCH MECHANISM

[75] Inventors: Ronald D. Hone, Fairview, Tenn.; William Harris, Lakewood, Ohio; James D. Edwards, Brentwood, Tenn.

[73] Assignee: The Scott & Fetzer Company, Fairview, Tenn.

[21] Appl. No.: 215,232

[22] Filed: Dec. 11, 1980

[51] Int. Cl.[3] ..... A47L 9/28

[52] U.S. Cl. ..... 15/319; 200/52 R

[58] Field of Search ..... 15/319, 331, 332, 333, 15/334; 307/139; 200/1 A, 1 B, 52 R, 52 A

[56] References Cited

U.S. PATENT DOCUMENTS

| | | | |
|---|---|---|---|
| 2,072,690 | 3/1937 | Smellie | 15/332 |
| 3,319,282 | 5/1967 | MacFarland | 15/319 |

*Primary Examiner*—Michael L. Gellner
*Assistant Examiner*—James L. Dwyer
*Attorney, Agent, or Firm*—Pearne, Gordon, Sessions, McCoy & Granger

[57] ABSTRACT

A safety switch for a vacuum cleaner which includes a vacuum cleaner housing, at least two attachments adapted to be affixed to the housing, and a switch casing fixed to the housing. First and second slides are mounted for reciprocation in the casing relative to the casing and relative to each other. A pair of socket openings are provided in the casing. Each of the slides are provided with a cam surface which is located in each socket opening. Each cam surface slopes inwardly toward a central axis of each socket. Each attachment has a probe adapted to enter one or the other of the sockets when the attachment is mounted on the cleaner. Each of the probes being adapted to move the first and second slides in opposite directions a predetermined total relative distance. The first slide is adapted to operate a first plurality of switch arms while the second slide is adapted to operate a second plurality of switch arms. The switch arms of one of the pluralities alternating with the switch arms of the other one of the pluralities so that contact will be made between at least two switch of each plurality when a probe is inserted in one of said sockets and so that contact will be made between at least four switch arms of each plurality when a probe is inserted in the other socket.

4 Claims, 7 Drawing Figures

CONTROLLED FORCE SAFETY SWITCH MECHANISM

BACKGROUND OF THE INVENTION

This invention relates to suction cleaners and, more particularly, to a safety switch for suction cleaners that automatically varies the speed of the suction cleaner motor in response to different types of attachments that are removably fixed to the body of the cleaner.

Many conventional suction cleaners employ a two-speed motor which is controlled by a manually-operated switch. For cleaning rugs and carpets, a low speed is desired, since the carpet pile or rug tends to block the suction end of the cleaner and may cause a high-speed motor to run hot because of the increased load on the fan. Moreover, if the beater brush is operated at a high speed on a carpet or rug, the suction cleaner wears the carpet pile too fast and the cleaner is difficult to push. A high speed is desirable in applications where dusting attachments are connected to the sweeper, since the ends of these attachments are spaced a considerable distance from the suction fan and a pressure drop occurs along the length of the hose from the dusting nozzle to the sweeper body.

Frequently, the operator becomes confused as to the speed recommended for a particular attachment, particularly in view of the variety of attachments being offered by vacuum cleaner manufacturers. Suction cleaners have been designed, therefore, to include switches which are responsive to a particular attachment. For example, in U.S. Pat. No. 2,072,690, there is disclosed a suction cleaner having a two-speed motor which is operated in response to a switch. The switch, in turn, is a two-position which is actuated to its first position only in response to a dusting attachment, to thereby run the motor at a relatively high speed, and is actuated to its second position only in response to a carpet cleaning nozzle to thereby run the motor at a relatively low speed. Prior art switches of the type shown in U.S. Pat. No. 2,072,690 control the motor speed by a field tap arrangement. One position of such a switch cuts out a portion of the field winding of the motor to permit the motor to run at higher speeds because of the decreased field resistance. The other position of the switch connects the line across the entire field winding to reduce the motor speed because of the increased field resistance.

The conventional switches have met with limited commercial success because of the expense involved in field tap wiring systems. A far simpler wiring arrangement for controlling the speed of a motor is to provide a switch that will connect the field windings in series for low speed operation and that will connect the field windings in parallel for high speed operations. Such a wiring arrangement in its simplest form, however, has not been employed since the field windings are short-circuited and the current is applied directly through the armature if the high speed and low speed switches are intentionally or inadvertently closed at the same time.

To overcome that problem, it has been proposed in U.S. Pat. No. 3,319,282 to employ a simple wiring arrangement and switch that will alternately connect the field windings of a motor in series for low speed cleaning operations in response to low speed cleaning attachments and which will connect the field windings in parallel for high spaced cleaning operations in response to the provision of high speed cleaning attachments on the cleaner. That patent discloses means to permit the alternate operation of the high speed and low speed switches, but prevents the simultaneous operation of both switches.

The object of U.S. Pat. No. 3,319,282 may be defeated, however, if either the high speed or low speed switch is operated intentionally or inadvertently by finger pressure with an attachment off, thus permitting the operator to insert his or her fingers into the fan. With the rise of product liability, therefore, manufacturers are striving for more foolproof safety systems to be built into their products.

It is proposed in a copending application to provide a safety switch which is automatically disconnected to disable the vacuum cleaner before access may be had to the nozzle or accessory attaching means. Thus, before access may be had to the fan, the safety switch must be disconnected from the cleaning attachment.

This is accomplished by mounting the safety switch within the headlight shroud so that when the shroud is in its down or closed position, the safety switch cooperates with lugs on the particular cleaning attachment to drive the motor at either a high or a low speed. In order to remove the attachment, the headlight shroud must be pivoted upwardly to gain access to the connecting lug for the attachment. However, when the headlight shroud is thus opened, the safety switch is disconnected from the attachment, since it is attached to the shroud.

The safety switch itself comprises a housing having spaced electrical contacts along one of its walls. A shiftable contact bar establishes electrical connections between certain pairs of those contacts, and is normally biased to a position wherein electrical connections are not made between the pairs of the contacts. The contact bar has cam surfaces at each end thereof which are adapted to be engaged by lugs which protrude from the attachments. When the contact bar is in its normally biased, first switch position, the motor is disconnected from an electrical circuit. When the contact bar is shifted by one of the lugs to a second contact position, an electrical connection is effected and the motor is run at a relatively low speed. If the lug moves the contact bar to a third switch position, the motor is caused to run at a relatively high speed.

While the switch disclosed in the above mentioned application overcomes many of the problems of the prior art, it has been found that certain problems exist in the operation of the switch. The switch is mounted at a fixed location on the headlight shroud and the attachments are removably attached to the vacuum housing. Due to manufacturing tolerances and wear during use, the lug on the attachment may not move the contact bar the predetermined distance to establish the desired contact. Movement may be too little or there may be overtravel, depending upon the entry axis of the lug in the socket.

SUMMARY OF THE INVENTION

This invention overcomes prior art problems, and particularly problems of under or overtravel of a safety switch member, but which retains other desirable features of that safety switch.

According to this invention, the safety switch housing is mounted within the headlight shroud so that when the shroud is in its down or closed position, the safety switch cooperates with lugs on the particular cleaning attachment to drive the motor at either a high or low speed. The safety switch comprises a switch casing containing first and second slide members which are mounted for reciprocation in opposite directions in the casing. A pair of socket openings are provided in the casing and each of the slides has a cam surface positioned in each socket opening. Each cam surface slopes inwardly toward a central axis of each socket and each attachment for the cleaner has a probe adapted to enter one or the other of the sockets, depending on whether the cleaner is to be run at a high speed or a low speed. Each probe is adapted to move the first and second slides in opposite directions a predetermined total relative distance which remains constant so long as the probe is inserted within a relatively large target area in the socket, which may deviate from the ideal axis of probe insertion. The first slide is connected to a first pair of switch arms and the second slide is connected to a second pair of switch arms. The switch arms of the first pair are alternately arranged with respect to the switch arms of the second pair so that contact will be made between two switch arms when a probe is inserted in one of the sockets and contact will be made between adjacent pairs of switch arms when the probe is inserted in the other socket. When a single contact is achieved, the field windings are placed in series for low speed operations, and when adjacent switch pairs make contact, the field windings are placed in parallel for high speed operations.

An important aspect of the invention is that uniform pressure between and among switch arms will obtain even if the probe insertion axis is misplaced, since contact pressure is solely a direct function of the probe diameter and any probe misalignment merely produces lost motion since the slides move together with their associated switch arms.

DETAILED DESCRIPTION OF THE INVENTION

Figure 1:
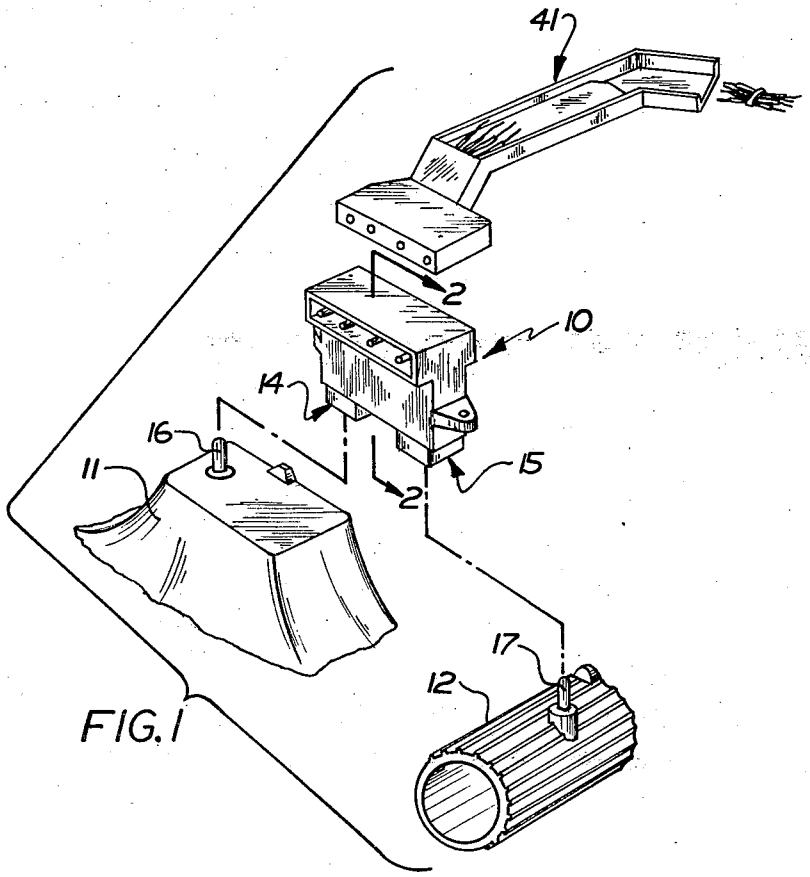
FIG. 1 is a fragmentary, exploded view of the safety switch, the wiring harness, and two different attachments which are adapted to be affixed to the motor housing.

Referring now to the drawings, and initially to FIG. 1, there is disclosed a safety switch 10 which is adapted to be engaged by either an on-the-floor rug cleaning nozzle 11 or, alternately, a tubular fitting 12 to which an off-the-floor cleaning hose (not shown) may be connected. The manner in which the rug nozzle 11 and tubular fitting 12 are fixed to the vacuum cleaner housing is set forth in detail in a copending application.

Figure 2:
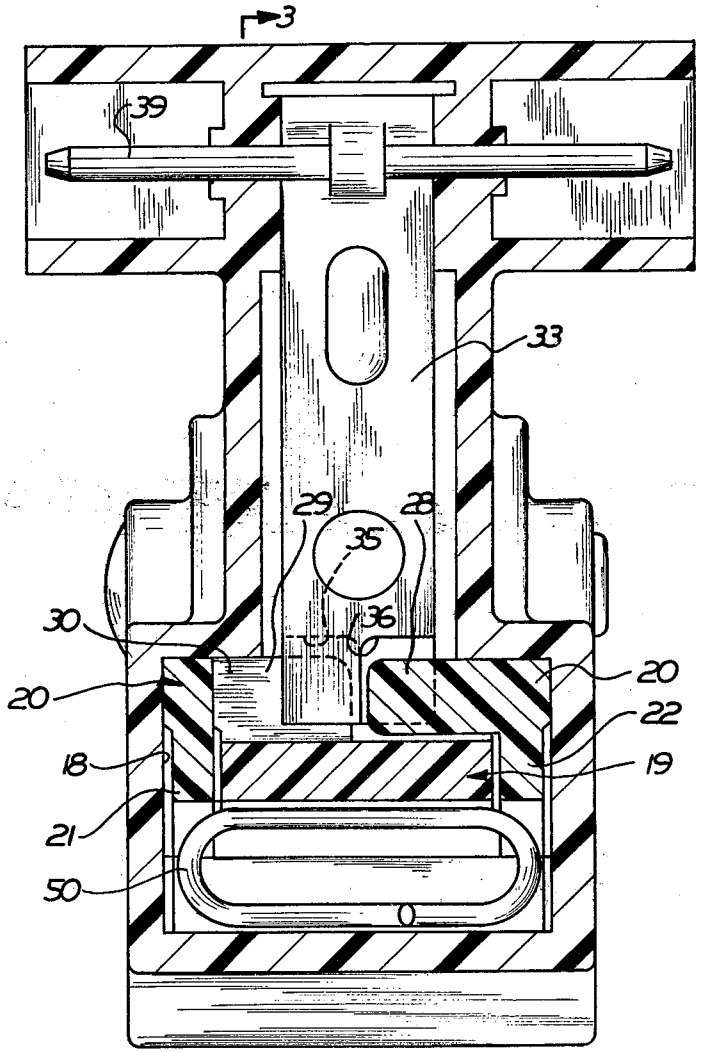
FIG. 2 is a cross-sectional view of the safety switch, the plane of the section being indicated by the line 2—2 in FIG. 1.
Figure 3:
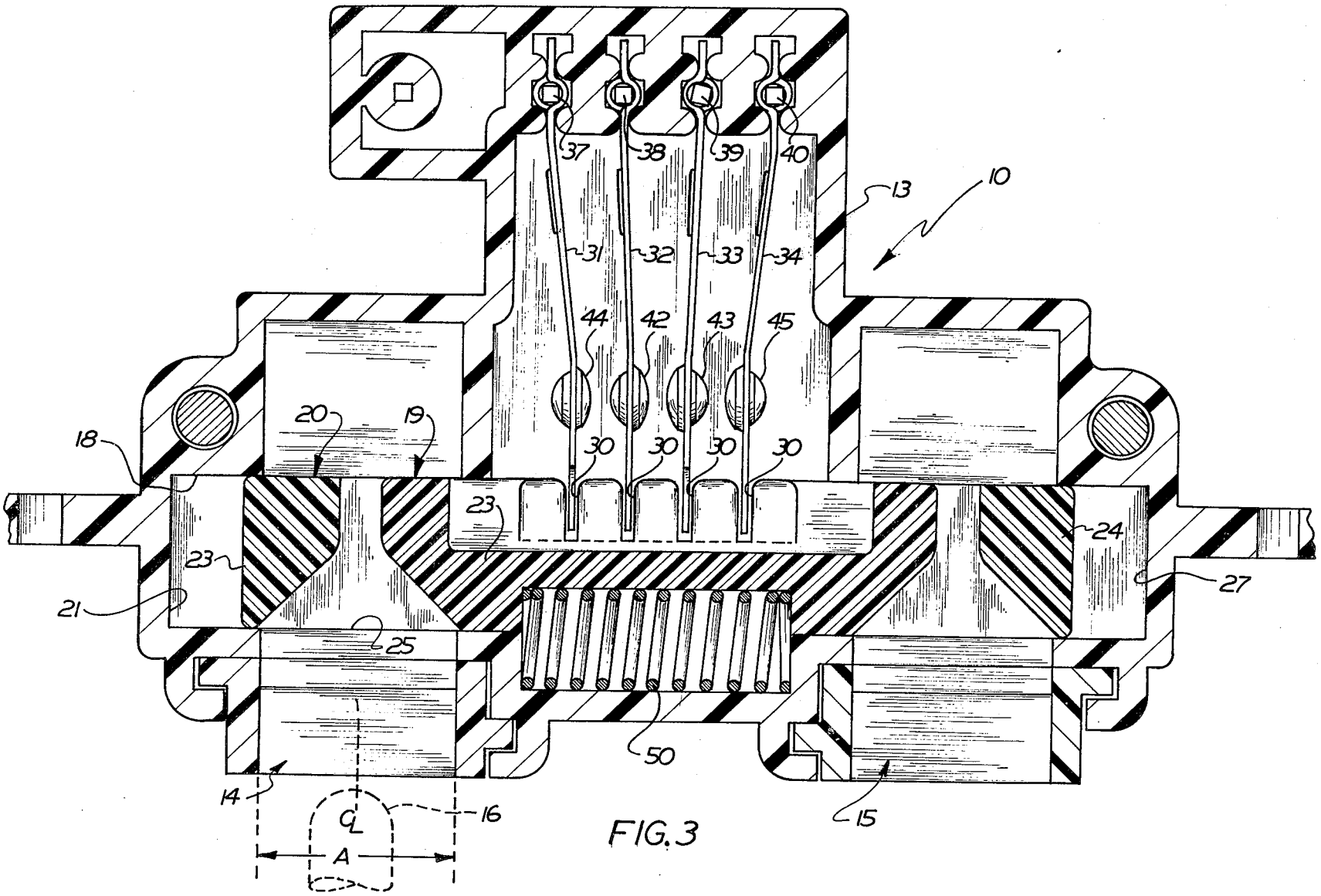
FIG. 3 is a cross-sectional view of the safety switch, the plane of the section being indicated by the line 3—3 in FIG. 2.

Referring now to FIGS. 2 and 3, the switch 10 includes a housing 13 which has a pair of socket openings 14 and 15 therein. The socket openings 14 and 15, respectively, are adapted to receive a prong 16 on a low-speed attachment, such as the rug cleaning nozzle 11, and a high-speed cleaning attachment, such as a prong 17 on the tubular fitting 12. The housing 13 further includes a slide chamber 18 within which an inner slide 19 and an outer slide 20 are mounted for reciprocation relative to the housing 13 and relative to each other. As may be seen most clearly in FIG. 2, the outer slide 20 has parallel side rails 21 and 22 which are joined at their ends by cross members 23 and 24. The outer slide 20 is slidable in either direction on a base portion 25 of the housing 13 toward and away from end walls 26 and 27 of the slide recess 18.

The inner slide 19 is received within the side rails 21 and 22, and is adapted to slide on the base 25.

The side rail 22 is provided with a horizontal extension 28 which overlies the inner slide member 19 and, similarly, the inner slide member 19 is provided with an extension 29 which faces the extension 28. The extensions 28 and 29 are provided with slots 30 which receive a plurality of switch arms 31, 32, 33, and 34. As may be seen most clearly in FIG. 2, the switch arms 31 and 33 are provided with notches 35 and the switch arms 32 and 34 are provided with notches 36. The notches 35 are dimensioned so that upon shifting of the inner slide 19, the slots 30 in that slide do not engage the switch arms 31 and 33. The notches 36 in the switch arms 32 and 34 are dimensioned so that they are not engaged by the slots 30 in the outer slide member 24 upon shifting of that member in either direction.

The switch arms 31–34 are respectively attached to terminal posts 37, 38, 39, and 40, which are adapted to be connected to the circuitry of the vacuum cleaner carried in the wire carrier 41.

Figure 4:
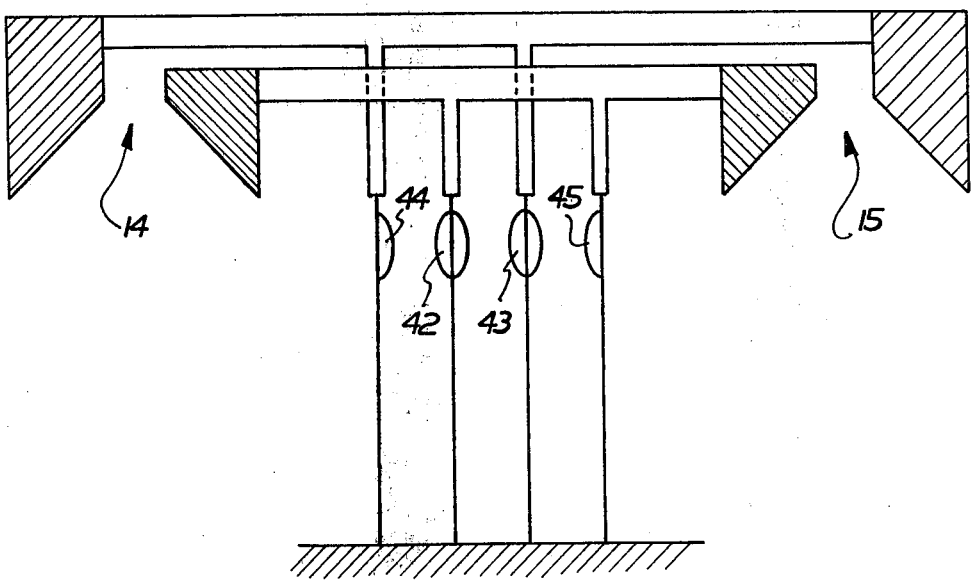
FIG. 4 is a schematic view illustrating the relationship between the first and second slides and the switch arms, with the sides and switch arms being illustrated in a nonoperative or centrally biased position.

The inner and outer slide members are maintained in a neutral or centered position (as illustrated in FIGS. 3 and 4) by a centering spring 50.

Figure 5:
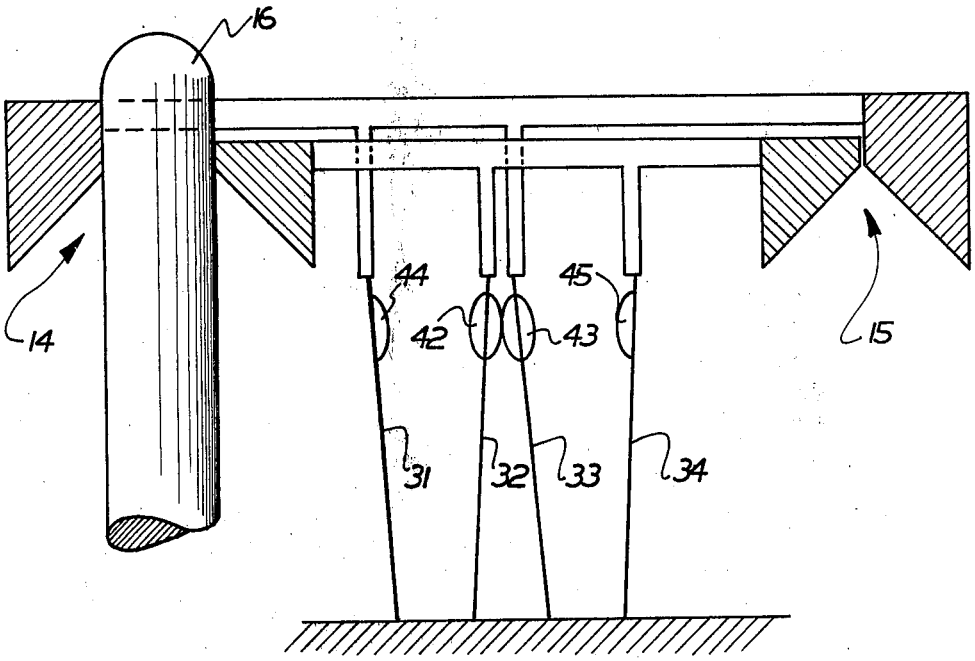
FIG. 5 is a schematic representation of the position of the slides and the switch arms, with a probe inserted in one of the sockets and showing the contact arms in a single contact position.
Figure 6:
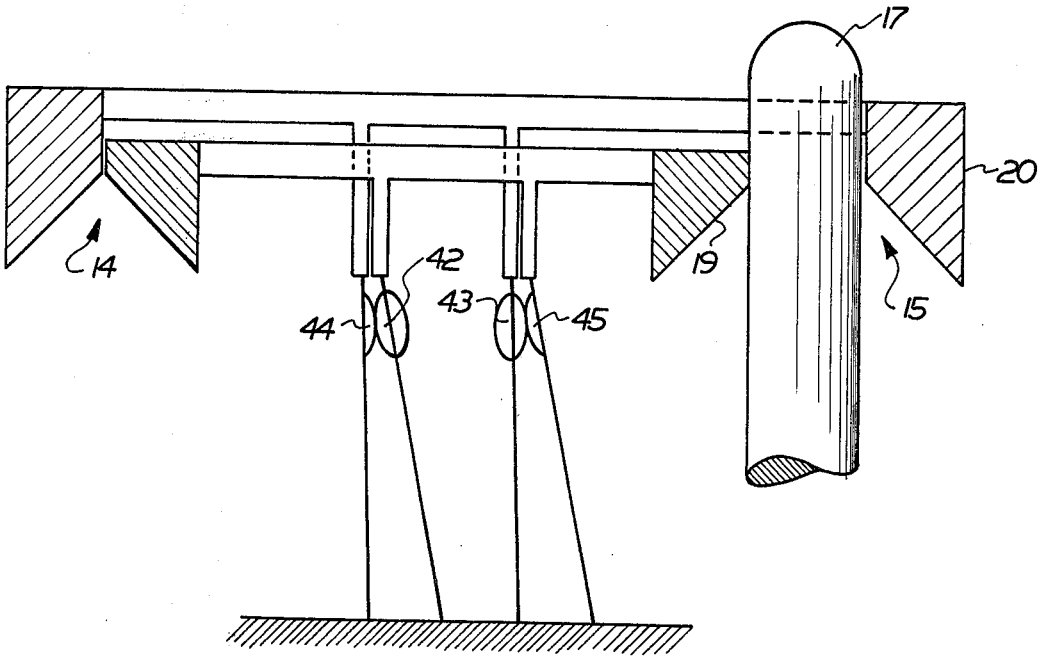
FIG. 6 is a schematic illustration of the slides and switch arms in another position wherein the probe is inserted in the other socket and illustrating pairs of adjacent switch arms in contact.
Figure 7:
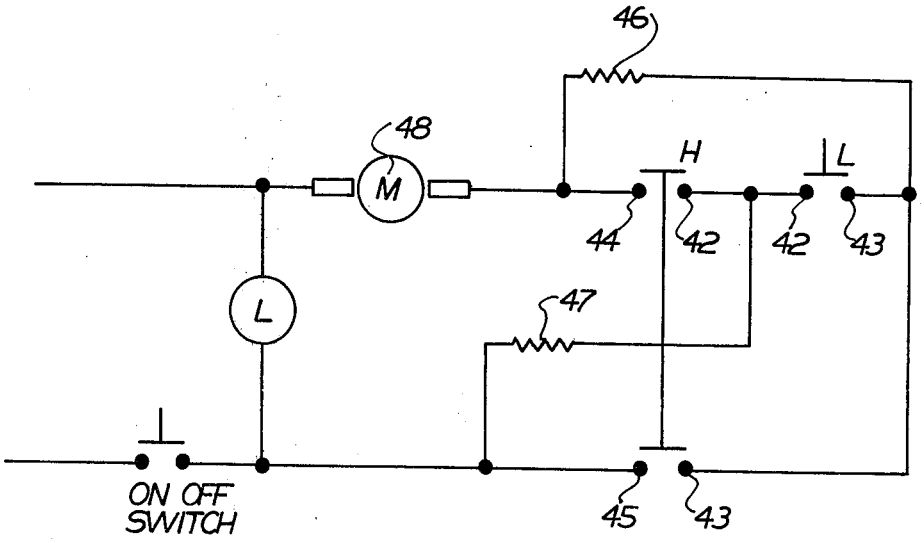
FIG. 7 is an illustration of the wiring diagram for the safety switch.

If, as may be seen schematically in FIGS. 5 through 7, a probe 16 is inserted in the socket 14, the inner and outer slides 19 and 20 will be shifted relative to each other so that switch arms 32 and 33 will be brought together so that contacts 42 and 43 on the switch arms 32 and 33 will be engaged, while contacts 44 and 45 on the switch arms 31 and 34 will be moved apart. Thus, referring to FIG. 7, it may be seen that closure of the contacts 42 and 43 will put the field windings 46 and 47 in series to establish a low speed motor operation, for example an operation involving the use of a rug suction nozzle 11.

If, on the other hand, an appliance is connected to the fan casing, such as the rug nozzle fitting 12, its probe 17 will enter the socket 15 to shift the inner slide 9 relative to the outer slide 20 so that contacts 42 and 44 are pressed together and contacts 43 and 45 are pressed together to establish electrical contact.

Referring again to FIG. 7, when contacts 42 and 43 are pressed together, field windings 46 and 47 are placed in series to establish low speed operation of the motor 48. When the contacts 42 and 44 and 43 and 45 are pressed together by insertion of the probe 17 into the socket 15, the field windings 46 and 47 are placed in parallel to establish a high speed motor operation.

A significant advantage of the present invention is that the inner and outer slides are moved a predetermined distance relative to each other, depending upon the diameter of the probes 16 and 17, and are capable of colinear movement even if the probes are misaligned with a center line $C_1$ of the sockets 14 and 15 within an extent A, as is indicated on FIG. 3. This feature produces substantially uniform contact between and among the switch contacts, since the inner and outer slide members are moved a relative distance which is dependent upon the diameter of the probes and are moved as a unit, depending upon any misalignment of the probe relative to the socket.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A safety switch for a vacuum cleaner comprising a vacuum cleaner housing, at least two attachments adapted to be affixed to said housing, a switch casing fixed to said housing, first and second slides mounted for reciprocation in said casing relative to the casing and relative to each other, a pair of socket openings in said casing, each of said slides having a cam surface positioned in each socket opening, each cam surface sloping inwardly toward a central axis of each socket, each attachment having a probe adapted to enter one or the other of said sockets when the attachment is mounted on the cleaner, each of said probes being adapted to move said first and second slides in opposite directions a predetermined total relative distance, said first slide being adapted to operate a first plurality of switch arms, said second slide being adapted to operate a second plurality of switch arms, the switch arms comprising one of said plurality alternating with the switch arms comprising the other one of said plurality, whereby contact will be made between at least two switch arms of each plurality when a probe is inserted in one of said sockets, and whereby contact will be made between at least four switch arms of each plurality when a probe is inserted in the other socket.

2. A safety switch for a vacuum cleaner according to claim 1, wherein said slides are provided with slots which receive the distal ends of said switch arms, alternate ones of said switch arms having cut-out portions on one side adapted to clear the sliding motion of the slots on one of said slides and the remainder of said switch arms having cut-out portions on one side adapted to clear the sliding motion of the slots on the other of said slides.

3. A safety switch for a vacuum cleaner according to claim 2, including means to bias said slides in a neutral position wherein said slides do not move said switch arms into contact.

4. In a vacuum cleaner having a motor housing, a motor in said housing, and at least two attachments adapted to be affixed to said housing, in combination therewith the improvement comprising a safety switch mounted on said housing, said safety switch including a switch casing, first and second slides mounted for reciprocation in said casing relative to the casing and relative to each other, a pair of socket openings in said casing, each of said slides having a cam surface sloping inwardly toward a central axis of said socket, each attachment having a probe adapted to enter one or the other of said sockets when the attachment is mounted on the cleaner, each of said probes being adapted to enter one or the other of said sockets when the attachment is mounted on the cleaner, each of said probes being adapted to move said first and second slides in opposite directions a predetermined total relative distance, said first slide being adapted to operate a first plurality of switch arms, said second slide being adapted to operate a second plurality of switch arms, the switch arms comprising one of said plurality alternating with the switch arms comprising the other one of said plurality, means electrically connecting the switch arms to the field windings of said motor, operation of said first plurality of switch arms causing contact between two of said switch arms to place the field windings of said motor in series for low speed motor operation, and operation of said second plurality of switch arms causing contact among four of said switch arms to place the field windings of said motor in parallel for high speed motor operations.

* * * * *